US007988773B2

(12) United States Patent
Kiso et al.

(10) Patent No.: US 7,988,773 B2
(45) **Date of Patent: *Aug. 2, 2011**

(54) ELECTROLESS GOLD PLATING BATH, ELECTROLESS GOLD PLATING METHOD AND ELECTRONIC PARTS

(75) Inventors: Masayuki Kiso, Hirakata (JP); Yoshikazu Saijo, Hirakata (JP); Tohru Kamitamari, Hirakata (JP)

(73) Assignee: C. Uyemura & Co., Ltd., Osaka-shi (JP)

( * ) Notice: Subject to any disclaimer, the term of this patent is extended or adjusted under 35 U.S.C. 154(b) by 798 days.

This patent is subject to a terminal disclaimer.

(21) Appl. No.: 11/987,881

(22) Filed: Dec. 5, 2007

(65) Prior Publication Data

US 2008/0138507 A1 Jun. 12, 2008

(30) Foreign Application Priority Data

Dec. 6, 2006 (JP) ..... 2006-328895

(51) Int. Cl.
*C23C 18/44* (2006.01)
*B05D 1/18* (2006.01)

(52) U.S. Cl. ..... 106/1.23; 106/1.26; 427/437

(58) Field of Classification Search ..... 106/1.23, 106/1.26; 427/437
See application file for complete search history.

(56) References Cited

U.S. PATENT DOCUMENTS

| | | | | | |
|---|---|---|---|---|---|
| 4,307,136 | A | * | 12/1981 | Prost-Tournier et al. | 106/1.23 |
| 4,792,469 | A | * | 12/1988 | Saito et al. | 106/1.26 |
| 5,380,562 | A | * | 1/1995 | Hattori et al. | 427/437 |
| 5,910,340 | A | * | 6/1999 | Uchida et al. | 106/1.23 |
| 2008/0138506 | A1 | * | 6/2008 | Kiso et al. | 106/1.23 |
| 2008/0138507 | A1 | * | 6/2008 | Kiso et al. | 106/1.23 |
| 2008/0277140 | A1 | * | 11/2008 | Kurosaka et al. | 427/443.1 |

FOREIGN PATENT DOCUMENTS

| | | | |
|---|---|---|---|
| JP | 2002-226975 | A | 8/2002 |
| JP | 2004-137589 | A | 5/2004 |
| WO | WO-2004/111287 | A2 | 12/2004 |

* cited by examiner

*Primary Examiner* — Helene Klemanski

(74) *Attorney, Agent, or Firm* — Birch, Stewart, Kolasch & Birch, LLP

(57) ABSTRACT

An electroless gold plating bath includes a water-soluble gold compound, a complexing agent, an aldehyde compound, and an amine compound represented by $R_1$—NH—$C_2H_4$—NH—$R_2$ or $(CH_2$—NH—$C_2H_4$—NH—$CH_2)_n$—$R_4$ (wherein $R_1$ to $R_4$ represent —OH, —$CH_3$, —$CH_2OH$, —$C_2H_4OH$, —$CH_2N(CH_3)_2$, —$CH_2NH(CH_2OH)$, —$CH_2NH(C_2H_4OH)$, —$C_2H_4NH(CH_2OH)$, —$C_2H_4NH(C_2H_4OH)$, —$CH_2N(CH_2OH)_2$, —$CH_2N(C_2H_4OH)_2$, —$C_2H_4N(CH_2OH)_2$ or —$C_2H_4N(C_2H_4OH)_2$, and n is an integer of 1 to 4). The electroless gold plating can be carried out without corrosion of an underlying metal to be plated at a stable deposition rate. Because of the high deposition rate and the immersion and reduction types, thickening of a plated coating is possible in one solution and the color of the coating is not degraded to provide a good appearance while keeping a lemon yellow color inherent to gold.

11 Claims, No Drawings

ELECTROLESS GOLD PLATING BATH, ELECTROLESS GOLD PLATING METHOD AND ELECTRONIC PARTS

CROSS-REFERENCE TO RELATED APPLICATION

This non-provisional application claims priority under 35 U.S.C. §119(a) on Patent Application No. 2006-328895 filed in Japan on Dec. 6, 2006, the entire contents of which are hereby incorporated by reference.

BACKGROUND OF THE INVENTION

This invention relates to an electroless gold plating bath, an electroless gold plating method using same, and electronic parts subjected to electroless gold plating by the method.

Gold exhibits the smallest ionization tendency among metals, meaning the most stable and most corrosion-resistant metal. In addition thereto, gold is excellent in electric conductivity and thus, has been in wide use in the fields of electronic industries. Immersion gold plating has been widely employed as a final surface treatment such as of circuits of printed board substrates and mounted or terminal portions of IC packages. In particular, the following methods are, for example, known with the following features, respectively.

(1) ENIG (Electroless Nickel Immersion Gold: Electroless Nickel/Immersion Gold)

- A method of forming an immersion gold plated coating formed on an underlying electroless nickel plated coating.
- Capable of preventing diffusion of Co, preventing oxidation of nickel, and improving a corrosion resistance of circuits or terminals.
- Usable for solder bonding.
- Usable in wire bonding by forming thickened gold after treatment of ENIG.
- With wire bonding, heat treatment is carried out after plating whereby nickel is diffused over a gold coating. To avoid this, electroless gold plating is performed on the nickel/immersion gold coating to increase the thickness of gold thereby coping with the diffusion of the nickel.

(2) DIG (Direct Immersion Gold: Direct Immersion Gold)

- A method of directly forming, on copper, an immersion gold plated coating.
- Capable of preventing oxidation of copper, preventing diffusion of copper and improving a corrosion resistance of circuits and terminals.
- Usable in solder bonding and wire bonding.
- Well usable under conditions where a thermal load is not imposed appreciably (i.e. under conditions of a low thermal treating temperature, a reduced number of reflow cycles and the like) although long-term reliability is slightly inferior to that of nickel/gold, nickel/palladium/gold or the like.
- Low in cost because of its simple process.

(3) ENEPIG (Electroless Nickel Electroless Palladium Immersion Gold: Electroless Nickel/Electroless Palladium/Immersion Gold)

- A method of forming an electroless palladium plated coating between an underlying electroless nickel plated coating and an immersion gold plated coating.
- Capable of preventing diffusion of copper, preventing oxidation and diffusion of nickel, and improving a corrosion resistance of circuits and terminals.
- Most suited for lead-free solder bonding which has been recently facilitated (because a lead-free solder needs a greater thermal load upon solder bonding than a tin-lead eutectic solder, and with nickel/gold, the bonding characteristic lowers).
- Suited for wire bonding
- No diffusion of nickel takes place if a gold thickness is not great.
- Suited for the case where better reliability is obtained although nickel/gold is applicable.

The immersion gold plating is such that gold is deposited by utilizing, in a plating bath, a difference in redox potential from an underlying layer such as of nickel, for which gold corrodes nickel to cause corrosion spots to occur owing to the oxidation (elution). The corrosion spots caused by the oxidation serve as an inhibition factor when tin and nickel in the solder layer are connected upon subsequent reflow of the solder, with the attendant problem that bonding characteristics such as strength lower.

In order to solve the problem, there have been disclosed an electroless gold plating bath including a sulfite adduct of aldehyde in Japanese Patent Laid-open No. 2004-137589 and a gold plating bath including a hydroxyalkylsulfonic acid in PCT Patent Publication No. WO 2004/111287, respectively. These techniques have for their object the suppression of corrosion of an underlying metal.

However, since these electroless gold plating baths have, as a reducing agent, a sulfonic acid group or a sulfite component, the following disadvantages are involved inherently to the case using a sulfonic acid group or sulfite component.

(1) Lowering of Deposition Rate

The sulfonic acid group or sulfite component acts as a stabilizer for gold deposition, thereby lowering a deposition rate of gold.

(2) Instability of Deposition Rate

A great difficulty is involved in control of a sulfonic acid group or sulfite component, thus leading to a difficulty in obtaining a stable deposition rate.

(3) Failure in Appearance in a Thickened State

Where thickening (0.1 μm or over) is performed using an electroless gold plating bath containing a sulfite component, the coating becomes reddish in appearance. This is because of deposition of particulate gold.

When using a primary amine compound where an amino group (—$NH_2$) exists, such as triethylenetetramine, as described in the PCT Patent Publication No. WO 2004/111287, intergranular corrosion proceeds in the nickel surface thereby lowering the coverage of gold, with the attendant disadvantage that the resulting coating becomes red in appearance.

DISCLOSURE OF THE INVENTION

The invention has been made under these circumstances and has for its object the provision of an electroless gold plating bath in which a stable and satisfactory deposition rate is ensured and which does not cause a failure in appearance when forming a thick coating, an electroless gold plating method using the same, and also electronic parts subjected to electroless gold plating by the method.

We have made intensive studies so as to solve the above problems and, as a result, found that an electroless gold plating bath, which includes a water-soluble gold compound, a complexing agent, an aldehyde compound serving as a reducing agent, and an amine compound having a specific type of structure represented by the following general formula (1) or (2).

$$R_1—NH—C_2H_4—NH—R_2 \quad (1)$$

$$R_3—(CH_2—NH—C_2H_4—NH—CH_2)_n—R_4 \quad (2)$$

(in the formulas (1) and (2), $R_1$, $R_2$, $R_3$ and $R_4$ represent —OH, —$CH_3$, —$CH_2OH$, —$C_2H_4OH$, —$CH_2N(CH_3)_2$, —$CH_2NH(CH_2OH)$, —$CH_2NH(C_2H_4OH)$, —$C_2H_4NH(CH_2OH)$, —$C_2H_4NH(C_2H_4OH)$, —$CH_2N(CH_2OH)_2$, —$CH_2N(C_2H_4OH)_2$, —$C_2H_4N(CH_2OH)_2$ or —$C_2H_4N(C_2H_4OH)_2$ and may be the same or different, and n is an integer of 1 to 4), is able to form an electroless gold plated coating while suppressing an underlying metal from being corroded and is also able to form an electroless gold plated coating having a good appearance while suppressing particulate gold from being deposited in case where the gold plated coating is made thick, thus arriving at completion of the invention.

More particularly, the invention provides the following electroless gold plating bath, electroless gold plating method and electronic parts.

[1] An electroless gold plating bath, including a water-soluble gold compound, a complexing agent, an aldehyde compound serving as a reducing agent, and an amine compound represented by the following general formula (1) or (2).

$$R_1—NH—C_2H_4—NH—R_2 \quad (1)$$

$$R_3—(CH_2—NH—C_2H_4—NH—CH_2)_n—R_4 \quad (2)$$

(in the formulas (1) and (2), $R_1$, $R_2$, $R_3$ and $R_4$ represent —OH, —$CH_3$, —$CH_2OH$, —$C_2H_4OH$, —$CH_2N(CH_3)_2$, —$CH_2NH(CH_2OH)$, —$CH_2NH(C_2H_4OH)$, —$C_2H_4NH(CH_2OH)$, —$C_2H_4NH(C_2H_4OH)$, —$CH_2N(CH_2OH)_2$, —$CH_2N(C_2H_4OH)_2$, —$C_2H_4N(CH_2OH)_2$ or —$C_2H_4N(C_2H_4OH)_2$ and may be the same or different, and n is an integer of 1 to 4).

[2] The electroless gold plating bath, wherein a molar ratio between the aldehyde compound and the amine compound is such that aldehyde compound:amine compound=1:30 to 3:1.

[3] The electroless gold plating bath, wherein the water-soluble gold compound consists of a gold cyanide salt.

[4] An electroless gold plating method, including a step of plating a metal surface of a base by the electroless gold plating bath.

[5] The electroless gold plating method, wherein the metal surface of the base is a surface of copper or a copper alloy.

[6] The electroless gold plating method, wherein the metal surface of the base is a surface of nickel or a nickel alloy.

[7] The electroless gold plating method, wherein the nickel or nickel alloy is an electroless nickel or electroless nickel alloy plated coating.

[8] The electroless gold plating method, wherein the metal surface of the base is a surface of palladium or a palladium alloy.

[9] The electroless gold plating method, wherein the palladium or palladium alloy is an electroless palladium or electroless palladium alloy plated coating.

[10] The electroless gold plating method, wherein the metal surface of the base is a surface of an electroless palladium or electroless palladium alloy plated coating formed on an electroless nickel or electroless nickel alloy plated coating.

[11] An electronic part being processed electroless gold plating according to the electroless gold plating method.

BENEFITS OF THE INVENTION

According to the invention, electroless gold plating can be carried out at a stable deposition rate without involving corrosion of an underlying metal to be plated. The deposition rate is high, and a plated coating can be thickened in one-bath solution because of the immersion and reduction types thereof. Moreover, if thickened, the coating is not degraded in color and keeps a lemon yellow color inherent to gold, with a good appearance.

DESCRIPTION OF THE PREFERRED EMBODIMENT

The invention is now described in detail.

The electroless gold plating bath of the invention includes a water-soluble gold compound, a complexing agent, an aldehyde compound serving as a reducing agent, and an amine compound represented by the following general formula (1) or (2).

$$R_1—NH—C_2H_4—NH—R_2 \quad (1)$$

$$R_3—(CH_2—NH—C_2H_4—NH—CH_2)_n—R_4 \quad (2)$$

(in the formulas (1) and (2), $R_1$, $R_2$, $R_3$ and $R_4$ represent —OH, —$CH_3$, —$CH_2OH$, —$C_2H_4OH$, —$CH_2N(CH_3)_2$, —$CH_2NH(CH_2OH)$, —$CH_2NH(C_2H_4OH)$, —$C_2H_4NH(CH_2OH)$, —$C_2H_4NH(C_2H_4OH)$, —$CH_2N(CH_2OH)_2$, —$CH_2N(C_2H_4OH)_2$, —$C_2H_4N(CH_2OH)_2$ or —$C_2H_4N(C_2H_4OH)_2$ and may be the same or different, and n is an integer of 1 to 4).

Unlike conventional immersion gold plating baths, the electroless gold plating bath of the invention is an immersion/reduction type of electroless gold plating bath wherein both an immersion reaction and a reduction reaction proceed in the same plating bath. Because an aldehyde compound serving as a reducing agent and an amine compound having a specific type of structure represented by the general formula (1) or (2) are contained in the gold plating bath, the electroless gold plating bath of the invention permits gold to be deposited on an underlying metal, such as copper, nickel or the like, by the immersion reaction and also permits gold to be deposited by means of the reducing agent using the deposited gold as a catalyst.

The electroless gold plating bath of the invention is able to suppress corrosion of an underlying metal to minimum, so that elution of the underlying metal ion to the plating bath is lessened and a stable deposition rate is kept over a long-term use. For instance, with ordinary immersion plating, the amounts of deposited gold and an eluted underlying metal (e.g. copper or nickel) become equal according to stoichiometry. With the plating bath of the invention, where a direct electroless gold plating process is carried out using, for example, copper as an underlying metal, most of deposited gold is shifted from immersion plating to reduction plating, so that the deposition of the eluted underlying metal relative to deposited gold is very small and is suppressed to about ⅛ of conventional, ordinary immersion plating.

In this way, the corrosion of the underlying metal can be suppressed to minimum and a uniform dense gold plated coating can be obtained. Since the reducing agent is contained, gold is continuously deposited over once deposited gold, thereby enabling the coating to be thickened in one plating bath without performing a separate gold plating procedure for thickening. Additionally, the deposition rate of gold can be maintained stably and when the coating is made thick, a plated coating keeps a lemon yellow color inherent to gold without turning into a reddish color.

Where the underlying metal is made of palladium, a potential difference between palladium and gold is small, unlike the case of nickel or copper. For this reason, when gold plating is carried out on palladium by use of a conventional immersion gold plating bath, a uniform coating thickness cannot be obtained and a satisfactory thickness cannot be obtained as well. In contrast thereto, the electroless gold plating bath of the invention is able to activate the surface of palladium and have gold deposited by means of a reducing agent using palladium as a catalyst. Moreover, gold can be further deposited by use of deposited gold as a catalyst, so that thickening of a gold plate coating on palladium is possible.

For the water soluble gold compound contained in the electroless gold plating bath of the invention, mention is made of gold cyanide salts such as gold cyanide, gold potassium cyanide, gold sodium cyanide, gold ammonium cyanide and the like, and gold thiosulfate salts, thiocyanide salts, sulfate salts, nitrate salts, methansulfonate salts, tetramine complexes, chlorides, bromides, hydroxides, oxides and the like, of which gold cyanide salts are preferred.

The content of the water-soluble gold compound preferably ranges 0.0001 to 1 mol/L, more preferably 0.001 to 0.5 mols/L, based on gold. If the content is smaller than the above range, there is concern that the deposition rate lowers, and the content exceeding the above range may result in poor economy.

The complexing agent contained in the electroless gold plating bath of the invention may be any known complexing agents used in electroless plating baths and includes, for example, phosphoric acid, boric acid, citric acid, gluconic acid, tartaric acid, lactic acid, malic acid, ethylenediamine, triethanolamine, ethylenediaminetetraacetic acid, nitrilotriacetic acid, diethylenetriaminepentaacetic acid, hydroxyethylethylenediamine tetraacetic acid, triethylenetetramine hexaacetic acid, 1,3-propanediamine tetraacetic acid, 1,3-diamino-2-hydroxypropane tetraacetic acid, hydroxyethyliminodiacetic acid, dihydroxyl glycine, glycol ether diamine tetraacetic acid, dicarboxymethylglutamic acid, hydroxyethylidenediphosphoric acid, ethylenediamine tetra(methylenephosphoric acid), or alkali metal (e.g. sodium or potassium) salts, alkaline earth metal salts or ammonium salts thereof, or the like.

The concentration of the complexing agent preferably ranges 0.001 to 1 mol/L, more preferably 0.01 to 0.5 mols/L. If the concentration is smaller than the above range, the deposition range may lower by the action of an eluted metal, and the concentration exceeding the above range may become poor in economy in some case.

Aldehyde compounds serving as a reducing agent are contained in the electroless gold plating bath of the invention. The aldehyde compound includes, for example, an aliphatic saturated aldehyde such as formaldehyde, acetoaldehyde, propionaldehyde, n-butylaldehyde, α-methylvaleraldehyde, β-methylvaleraldehyde, γ-methylvaleraldehyde or the like, an aliphatic dialdehyde such as glyoxal, succindialdehdye or the like, an aliphatic unsaturated aldehyde such as croton aldehyde or the like, an aromatic aldehyde such as benzaldehyde, o-nitrobenzaldehyde, m-nitrobenzaldehyde, p-nitrobenzaldehyde, o-tolaldehyde, m-tolaldehyde, p-tolaldehyde, o-hydroxybenzaldehyde, m-hydroxybenzaldehyde, p-hydroxybenzaldehyde, phenylacetoaldehyde or the like, or a sugar having an aldehyde group (—CHO) such as glucose, galactose, mannose, ribose, maltose, lactose or the like, of which formaldehyde is preferred.

The concentration of these aldehyde compounds preferably ranges 0.0001 to 0.5 mols/L, more preferably 0.001 to 0.3 mols/L. If the concentration is smaller than the above range, there is concern that the deposition rate lowers. Over the above range, the bath may become instable.

The electroless gold plating bath of the invention contains an amine compound represented by the following general formula (1) or (2).

$$R_1—NH—C_2H_4—NH—R_2 \quad (1)$$

$$R_3—(CH_2—NH—C_2H_4—NH—CH_2)_n—R_4 \quad (2)$$

(in the formulas (1) and (2), $R_1$, $R_2$, $R_3$ and $R_4$ represent —OH, —$CH_3$, —$CH_2OH$, —$C_2H_4OH$, —$CH_2N(CH_3)_2$, —$CH_2NH(CH_2OH)$, —$CH_2NH(C_2H_4OH)$, —$C_2H_4NH(CH_2OH)$, —$C_2H_4NH(C_2H_4OH)$, —$CH_2N(CH_2OH)_2$, —$CH_2N(C_2H_4OH)_2$, —$C_2H_4N(CH_2OH)_2$ or —$C_2H_4N(C_2H_4OH)_2$ and may be the same or different, and n is an integer of 1 to 4). In the plating bath of the invention, an aldehyde compound does not act as a reducing agent when used alone, but causes the reduction action to occur in coexistence with the amine compound.

The concentration of these amine compounds preferably ranges 0.001 to 3 mols/L, more preferably 0.01 to 1 mol/L. If the concentration is smaller than above range, there is concern that the deposition rate lowers. Over the above range, the bath may become instable.

The molar ratio in content between the aldehyde compound and the amine compound is such that aldehyde compound:amine compound=1:30 to 3:1, preferably 1:10 to 1:1. If the aldehyde is present in amounts larger than the above range, there is concern that the bath becomes instable. The concentration of the aldehyde compound over the above range may result in poor economy.

In the electroless gold plating bath of the invention, stabilizers used in known electroless plating may be added. For such a stabilizer, mention is made of sulfur compounds such as 2-mercaptobenzothiazole, 2-mercaptobenzoimidazole, mercaptoacetic acid, mercaptosuccinic acid, thiosulfuric acid, thioglycol, thiourea, thiomalic acid and the like, and nitrogen compounds such as benzotriazole, 1,2,4-aminotriazole and the like.

The concentration of the stabilizer preferably ranges 0.0000001 to 0.01 mol/L, more preferably 0.000001 to 0.005 mols/L. If the concentration is smaller than the above range, there is concern that the bath becomes instable, and the concentration exceeding the above range may result in poor economy.

It will be noted that the electroless gold plating bath of the invention should preferably have a smaller content of a sulfite such as sodium sulfite, a sulfite derivative such as hydroxymethanesulfonic acid and a sulfonic acid compound, particularly at 10 mg/L or below. If the content exceeds 10 mg/L, there is concern that the deposition rate of gold cannot be stably maintained. Additionally, there is also concern that a disadvantage is caused in that the appearance of a plated coating that has been thickened becomes reddish. As a matter of course, it is needless to say that the electroless gold plating bath is most preferably free of such a sulfite, sulfite derivative and sulfonic acid compound as mentioned above.

The pH of the electroless gold plating bath of the invention preferably ranges 5 to 10. If the pH is smaller than the above range, there is concern that the deposition rate lowers. Over the above range, the bath may become instable. For a pH adjuster, there can be used sodium hydroxide, potassium hydroxide, ammonia, sulfuric acid, phosphoric acid, boric acid or the like, which is used in ordinary plating baths.

The temperature of the electroless gold plating bath of the invention preferably ranges 40 to 90° C. Temperatures lower than the above range may lower the deposition rate. Over the above range, the bath may become instable.

When the electroless gold plating bath of the invention is used and a metal surface is brought into contact with the electroless gold plating bath, the metal surface of a base can be electrolessly gold-plated. In this connection, a gold plated coating of 0.01 to 2 μm in thickness can be formed when the contact time is, for example, at 5 to 60 minutes, and the gold plated coating can be formed at a deposition rate, for example, of 0.002 to 0.03 μm/minute.

For a material of the metal surface (surface to be plated) of a base, mention can be made of copper, a copper alloy, nickel, a nickel alloy, palladium, a palladium alloy and the like. Examples of the nickel alloy include nickel-phosphorus alloy, nickel-boron alloy and the like, and examples of the palladium alloy include palladium-phosphorus alloy and the like. Such a metal surface may include, aside from a surface of the case where a base itself is made of a metal, a coating surface where a metallic coating is formed on a base surface. The metallic coating may be either one that is formed by electroplating or one that is formed by electroless plating. In this connection, with the case of nickel, a nickel alloy, palladium and a palladium alloy, it is usual to form those coatings by electroless plating. Moreover, a palladium or palladium alloy coating surface formed on a base through a nickel or nickel alloy coating is suited for electroless gold plating.

The electroless gold plating bath of the invention can be used for the formation of a gold plated coating, for example, by any of ENIG (Electroless Nickel Immersion Gold), i.e. a method of forming a gold plated coating on an underlying electroless nickel plated coating, DIG (Direct Immersion Gold), i.e. a method of forming a gold plated coating directly on copper, and ENEPIG (Electroless Nickel, Electroless Palladium Immersion Gold), i.e. a method of forming a gold plated coating on an underlying electroless nickel coating through an electroless palladium coating. In any of the cases, the use of the electroless gold plating bath of the invention enables a given thickness of a gold plated coating on a nickel surface, a copper surface or a palladium surface within such a range as defined above to be formed.

The electroless gold plating bath and the electroless gold plating method using the same according to the invention are suited for gold plating, for example, of wiring circuit mounting portions or terminal portions of electronic parts such as printed circuit boards, IC packages and the like.

It will be noted that with the plating bath of the invention, a good coating can be obtained in case where the metallic surface (a surface to be plated) is formed of copper and when copper is an underlying layer, good solder bonding characteristics such as of suppressing copper from oxidation and diffusion can be obtained. In addition, the plating bath of the invention allows a gold coating of good quality to be deposited on palladium and is optimized in application to lead-free solder bonding or wire bonding.

EXAMPLES

Examples and Comparative Example are shown to more particularly illustrate the invention, which should not be construed as limited to the following examples.

Examples 1 to 6

Comparative Examples 1 to 8

Gold plating baths having compositions indicated in Tables 1 to 3 were used, and treatments indicated in Tables 4 to 6 were carried out relative to copper-clad printed boards by (1) direct electroless gold plating process, (2) nickel/gold plating process and (3) nickel/palladium/gold process, followed by immersion of the thus treated copper-clad printed boards in gold plating baths for gold plating. The thickness, the presence or absence of pits confirmed by microscopic observation, and the appearance of the resulting gold plated coatings are shown in Tables 1 to 3.

TABLE 1

| | | Example | | | | | |
|---|---|---|---|---|---|---|---|
| | | 1 | 2 | 3 | 4 | 5 | 6 |
| Bath Composition | Gold potassium cyanide (g/L) | 2 | 2 | 2 | 2 | 2 | 2 |
| | Ethylenediamine tetraacetic acid (g/L) | | | 15 | 15 | | |
| | Nitrilotriacetic acid (g/L) | | 15 | | | 15 | |
| | Triethylenetetramine hexaacetic acid (g/L) | 15 | | | | | 15 |
| | Formaldehyde (g/L) | | 1 | | 1 | | 1 |
| | Acetoaldehyde (g/L) | 1 | | | | 1 | |
| | Benzaldehyde (g/L) | | | 1 | | | |
| | Sodium hydroxymethanesulfonate (g/L) | | | | | | |
| | 2-Hydroxyethanesulfonic acid (g/L) | | | | | | |
| | Amine compound-1 (g/L) | 20 | | | 20 | | |
| | Amine compound-2 (g/L) | | | 20 | | | 20 |
| | Amine compound-3 (g/L) | | 20 | | | 20 | |
| | Triethanolamine (g/L) | | | | | | |
| | Triethylenetetramine (g/L) | | | | | | |
| | Sodium sulfite (mg/L) | | | | | | 5 |
| | pH | 7 | 7 | 7 | 7 | 7 | 7 |
| Gold coating thickness (μm) | (1) Direct electroless gold process | 0.34 | 0.30 | 0.31 | 0.30 | 0.31 | 0.32 |
| | (2) Nickel/gold process | 0.41 | 0.36 | 0.33 | 0.36 | 0.37 | 0.35 |
| | (3) Nickel/palladium/gold process | 0.33 | 0.31 | 0.31 | 0.31 | 0.32 | 0.31 |
| Pits | (1) Direct electroless gold process | no | no | no | no | no | no |
| | (2) Nickel/gold process | no | no | no | no | no | no |
| | (3) Nickel/palladium/gold process | no | no | no | no | no | no |
| Appearance | (1) Direct electroless gold process | lemon yellow | lemon yellow | lemon yellow | lemon yellow | lemon yellow | lemon yellow |
| | (2) Nickel/gold process | lemon yellow | lemon yellow | lemon yellow | lemon yellow | lemon yellow | lemon yellow |
| | (3) Nickel/palladium/gold process | lemon yellow | lemon yellow | lemon yellow | lemon yellow | lemon yellow | lemon yellow |

TABLE 2

| | | Comparative Example | | | |
|---|---|---|---|---|---|
| | | 1 | 2 | 3 | 4 |
| Bath Composition | Gold potassium cyanide (g/L) | 2 | 2 | 2 | 2 |
| | Ethylenediamine tetraacetic acid (g/L) | 15 | | 15 | |
| | Nitrilotriacetic acid (g/L) | | 15 | | |
| | Triethylenetetramine hexaacetic acid (g/L) | | | | 15 |
| | Formaldehyde (g/L) | | 1 | | |
| | Acetoaldehyde (g/L) | | | | |
| | Benzaldehyde (g/L) | | | | |
| | Sodium hydroxymethanesulfonate (g/L) | | | | 2 |
| | 2-Hydroxyethanesulfonic acid (g/L) | | | | |
| | Amine compound-1 (g/L) | | | 20 | |
| | Amine compound-2 (g/L) | | | | |
| | Amine compound-3 (g/L) | | | | 20 |
| | Triethanolamine (g/L) | | | | |
| | Triethylenetetramine (g/L) | | | | |
| | Sodium sulfite (mg/L) | | | | |
| | pH | 7 | 7 | 7 | 7 |
| Gold coating thickness (μm) | (1) Direct electroless gold process | 0.051 | 0.048 | 0.052 | 0.12 |
| | (2) Nickel/gold process | 0.066 | 0.066 | 0.074 | 0.14 |
| | (3) Nickel/palladium/gold process | below 0.01 | below 0.01 | below 0.01 | 0.11 |
| Pits | (1) Direct electroless gold process | yes | yes | yes | no |
| | (2) Nickel/gold process | yes | yes | yes | no |
| | (3) Nickel/palladium/gold process | yes | yes | yes | no |
| Appearance | (1) Direct electroless gold process | reddish yellow (insufficient thickness) | reddish yellow (insufficient thickness) | reddish yellow (insufficient thickness) | reddish yellow |
| | (2) Nickel/gold process | lemon yellow (insufficient thickness) | lemon yellow (insufficient thickness) | lemon yellow (insufficient thickness) | reddish yellow |
| | (3) Nickel/palladium/gold process | little deposition | little deposition | little deposition | reddish yellow |

TABLE 3

| | | Comparative Example | | | |
|---|---|---|---|---|---|
| | | 5 | 6 | 7 | 9 |
| Bath Composition | Gold potassium cyanide (g/L) | 2 | 2 | 2 | 2 |
| | Ethylenediamine tetraacetic acid (g/L) | 15 | | 15 | |
| | Nitrilotriacetic acid (g/L) | | 15 | | 15 |
| | Triethylenetetramine hexaacetic acid (g/L) | | | | |
| | Formaldehyde (g/L) | | 1 | 1 | |
| | Acetoaldehyde (g/L) | | | | 1 |
| | Benzaldehyde (g/L) | | | | |
| | Sodium hydroxymethanesulfonate (g/L) | | | | |
| | 2-Hydroxyethanesulfonic acid (g/L) | 2 | | | |
| | Amine compound-1 (g/L) | | 20 | | |
| | Amine compound-2 (g/L) | | | | |
| | Amine compound-3 (g/L) | 20 | | | |
| | Triethanolamine (g/L) | | | 10 | |
| | Triethylenetetramine (g/L) | | | | 20 |
| | Sodium sulfite (mg/L) | | 1 | | |
| | pH | 7 | 7 | 7 | 7 |
| Gold coating thickness (μm) | (1) Direct electroless gold process | 0.12 | 0.12 | 0.049 | 0.34 |
| | (2) Nickel/gold process | 0.14 | 0.14 | 0.068 | 0.35 |
| | (3) Nickel/palladium/gold process | 0.11 | 0.11 | below 0.01 | 0.31 |
| Pits | (1) Direct electroless gold process | no | no | yes | no |
| | (2) Nickel/gold process | no | no | yes | no |
| | (3) Nickel/palladium/gold process | no | no | yes | no |

TABLE 3-continued

| | | Comparative Example | | | |
|---|---|---|---|---|---|
| | | 5 | 6 | 7 | 9 |
| Appearance | (1) Direct electroless gold process | reddish yellow | reddish yellow | reddish yellow (insufficient thickness) | reddish yellow |
| | (2) Nickel/gold process | reddish yellow | reddish yellow | lemon yellow (insufficient thickness) | reddish yellow |
| | (3) Nickel/palladium/gold process | reddish yellow | reddish yellow | little deposition | reddish yellow |

Amine compound-1: $R_1$—NH—$C_2H_4$—NH—$R_2$ [wherein $R_1$ = —$C_2H_4OH$ and $R_2$ = —$C_2H_4OH$]
Amine compound-2: $R_3$—($CH_2$—NH—$C_2H_4$—NH—$CH_2$)$_n$—$R_4$ [wherein n = 1, $R_3$ = —$CH_2NH(CH_2OH)$ and $R_4$ = —$CH_2NH(CH_2OH)$]
Amine compound-3: $R_3$—($CH_2$—NH—$C_2H_4$—NH—$CH_2$)$_n$—$R_4$ [wherein n = 2, $R_3$ = —$CH_2N(CH_3)_2$ and $R_4$ = —$CH_2N(CH_3)_2$]

(1) Direct Electroless Gold Plating Process

TABLE 4

| | | Temperature (° C.) | Time (minutes) |
|---|---|---|---|
| Cleaner | ACL-009 (made by C. Uyemura & Co., Ltd.) | 50 | 5 |
| Soft etching | Sodium persulfate: 100 g/L $H_2SO_4$: 20 g/L | 25 | 1 |
| Acid cleaning | $H_2SO_4$: 100 g/L | 25 | 1 |
| Gold plating | Baths indicated in tables 1 to 3 | 80 | 40 |

Water washing carried out between the respective steps.

(2) Nickel/Gold Plating Process

TABLE 5

| | | Temperature (° C.) | Time (minutes) |
|---|---|---|---|
| Cleaner | ACL-009 (made by C. Uyemura & Co., Ltd.) | 50 | 5 |
| Soft etching | Sodium persulfate: 100 g/L $H_2SO_4$: 20 g/L | 25 | 1 |
| Acid cleaning | $H_2SO_4$: 100 g/L | 25 | 1 |
| Activator | MNK-4 (made by C. Uyemura & Co., Ltd.) | 30 | 2 |
| Electroless nickel plating | Nimuden NPR-4 (made by C. Uyemura & Co., Ltd.) | 80 | 30 |
| Gold plating | Baths indicated in Tables 1 to 3 | 80 | 40 |

Water washing carried out between the respective steps.

(3) Nickel/Palladium/Gold Process

TABLE 6

| | | Temperature (° C.) | Time (minutes) |
|---|---|---|---|
| Cleaner | ACL-009 (made by C. Uyemura & Co., Ltd.) | 50 | 5 |
| Soft etching | Sodium persulfate: 100 g/L $H_2SO_4$: 20 g/L | 25 | 1 |
| Acid cleaning | $H_2SO_4$: 100 g/L | 25 | 1 |

TABLE 6-continued

| | | Temperature (° C.) | Time (minutes) |
|---|---|---|---|
| Activator | MNK-4 (made by C. Uyemura & Co., Ltd.) | 30 | 2 |
| Electroless nickel plating | Nimuden NPR-4 (made by C. Uyemura & Co., Ltd.) | 80 | 30 |
| Electroless palladium plating | TPD-30 (made by C. Uyemura & Co., Ltd.) | 50 | 5 |
| Gold plating | Baths indicated in tables 1 to 3 | 80 | 40 |

Water washing carried out between the respective steps.

In Comparative Examples 1 to 3 and 7, the immersion reaction alone was carried out, so that the coating thickness became inadequate in the direct electroless gold process and nickel/gold process, and little deposition was found in the nickel/palladium/gold process.

In Comparative Examples 4, 5, the deposition rate lowered with an appearance becoming reddish.

In Comparative Example 8, an appearance became reddish.

From the foregoing results, it will be seen that the electroless gold plating baths of the invention are excellent in the following respects.

(1) Pit-free gold coating can be formed.

(2) The deposition rate becomes very high because neither sulfite component nor sulfonic acid component is contained.

(3) If thickened, a good lemon yellow appearance inherent to gold is shown.

(4) Thickening of a gold plated coating is possible in one solution.

Japanese Patent Application No. 2006-328895 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. An electroless gold plating bath, comprising a water-soluble gold compound, a complexing agent, an aldehyde compound, and an amine compound represented by the following general formula (1) or (2):

$$R_1—NH—C_2H_4—NH—R_2 \quad (1)$$

$$R_3—(CH_2—NH—C_2H_4—NH—CH_2)_n—R_4 \quad (2)$$

wherein in the formulas (1) and (2), $R_1$, $R_2$, $R_3$ and $R_4$ represent —OH, $—CH_3$, $—CH_2OH$, $—C_2H_4OH$, $—CH_2N(CH_3)_2$, $—CH_2NH(CH_2OH)$, $—CH_2NH(C_2H_4OH)$, $—C_2H_4NH(CH_2OH)$, $—C_2H_4NH(C_2H_4OH)$, $—CH_2N(CH_2OH)_2$, $—CH_2N(C_2H_4OH)_2$, $—C_2H_4N(CH_2OH)_2$ or $—C_2H_4N(C_2H_4OH)_2$ and may be the same or different, and n is an integer of 1 to 4.

2. The electroless gold plating bath according to claim 1, wherein a molar ratio between the aldehyde compound and the amine compound is such that aldehyde compound:amine compound=1:30 to 3:1.

3. The electroless gold plating bath according to claim 1, wherein said water-soluble gold compound consists of a gold cyanide salt.

4. An electroless gold plating method, comprising a step of plating a metal surface of a base by the electroless gold plating bath defined in claim 1.

5. The electroless gold plating method according to claim 4, wherein the metal surface of said base is a surface of copper or a copper alloy.

6. The electroless gold plating method according to claim 4, wherein the metal surface of the base is a surface of nickel or a nickel alloy.

7. The electroless gold plating method according to claim 6, wherein said nickel or nickel alloy is an electroless nickel or electroless nickel alloy plated coating.

8. The electroless gold plating method according to claim 4, wherein the metal surface of said base is a surface of palladium or a palladium alloy.

9. The electroless gold plating method according to claim 8, wherein said palladium or palladium alloy is an electroless palladium or an electroless palladium alloy plated coating.

10. The electroless gold plating method according to claim 4, wherein the metal surface of said base is a surface of an electroless palladium or electroless palladium alloy plated coating formed on an electroless nickel or electroless nickel alloy plated coating.

11. The electroless gold plating method according to claim 4, wherein a metal surface of an electronic part is plated by said electroless gold plating bath.

* * * * *